US006817497B2

(12) United States Patent
Grasso et al.

(10) Patent No.: US 6,817,497 B2
(45) Date of Patent: Nov. 16, 2004

(54) GARMENT CARE APPARATUS

(75) Inventors: Andre Grasso, Garrison, NY (US); Joel Miller, Harrington Park, NJ (US)

(73) Assignee: Black + Gray Design + Manufacturing, New York, NY (US)

( * ) Notice: Subject to any disclaimer, the term of this patent is extended or adjusted under 35 U.S.C. 154(b) by 0 days.

(21) Appl. No.: 10/215,850

(22) Filed: Aug. 9, 2002

(65) Prior Publication Data

US 2004/0026469 A1 Feb. 12, 2004

(51) Int. Cl.[7] ..... A41D 27/22
(52) U.S. Cl. ..... 223/90; 223/87; 223/94
(58) Field of Search ..... 223/90, 87, 94

(56) References Cited

U.S. PATENT DOCUMENTS 1,997,251 A * 4/1935 Field ..... 223/90
2,283,530 A * 5/1942 Bohachef ..... 223/91
2,463,136 A * 3/1949 Baer ..... 223/90
2,512,133 A * 6/1950 Baer ..... 223/90
2,573,467 A * 10/1951 Macaluso ..... 223/90
6,206,254 B1 * 3/2001 Lin ..... 223/94

* cited by examiner

*Primary Examiner*—Gary L. Welch
*Assistant Examiner*—James G Smith

(57) ABSTRACT

A garment care apparatus includes a frame segment with a top hook portion and a main body portion. the apparatus may also include a pair of adjustable shoulder segments detachably secured to the frame segment on opposite sides of the frame segment in one of at least two different positions on the frame segment. In addition, the apparatus may include one or more clip segments detachably fastened to the main body portion of the frame segment.

6 Claims, 3 Drawing Sheets

GARMENT CARE APPARATUS

BACKGROUND OF THE INVENTION

1. Field of the Invention

The present invention generally relates to a garment care system, and more particularly, to an adjustable heavy duty garment hanger which may include shoulder supports that allow width adjustment of the hanger and that support garments (including large and heavy garments) in an open configuration, allowing them to vent, dry and maintain their shape.

2. Description of Related Art

Garments come in a wide variety of sizes, shapes and weights, depending on their nature and the size of the person wearing them. To store these garments, one typically hangs them on hooks, bars or similar structure using some type of hanging device. The prior art includes a multitude of such hanging devices. These prior devices suffer a number of disadvantages, including failure to provide adequate support, to maintain the shape of the garments during storage, or to minimize the marks and creases that the devices impart to the garments.

It is desirable for a garment hanger to have a heavy duty construction for supporting heavy garments and to have adjustable shoulder supports for accommodating garments with different shoulder widths. A garment hanger should also have shoulder support portions of increased thickness (or lateral projection) for holding garments in an open manner, allowing them to vent, dry, and maintain their shape. Finally, a garment hanger should also include adjustable clips that secure pants, accessories, and similar garments.

The garment care apparatus of the present invention includes all of the desirable features outlined above. It provides a robust and simple construction which minimizes the cost of fabrication and assembly, yet provides effective and reliable support for a wide variety of garments. It maintains the shape of the garments that it supports, minimizing the marks and creases that it imparts to those garments.

SUMMARY OF THE INVENTION

In accordance with one embodiment of the present invention, a garment care apparatus includes a frame segment with a top hook portion for hanging the apparatus on a hook or bar. It may also include a pair of adjustable shoulder segments secured to the frame segment on opposite sides of the frame segment, and securing means for detachably securing the shoulder segments to the frame segment in at least two different positions on the frame segment. One or more clip segments may normally lie secured to a bottom edge of a main body portion of the frame segment.

The frame segment is generally a flat plate-like member; and the shoulder segments are cup-like members that extend over the frame and project a substantial distance laterally outwardly of the frame member. The shoulder segments support a garment at the shoulder region of a garment that a person wears around his or her shoulders while the clip segments support accessories such as gloves and garments such as pants. The shape of the shoulder segments may differ, depending on the nature of the garments that the apparatus supports.

BRIEF DESCRIPTION OF THE DRAWINGS

For a more complete understanding of this invention, one should now refer to the embodiment illustrated in greater detail in the accompanying drawings and described below by way of an example of the invention. In the drawings.

While the following disclosure describes the invention in connection with one embodiment, one should understand that the invention is not limited to this embodiment. Furthermore, one should understand that the drawings are not to scale and that graphic symbols, diagrammatic representatives, and fragmentary views, in part, may illustrate the embodiment. In certain instances, the disclosure may not include details which are necessary for an understanding of the present invention.

DETAILED DESCRIPTION OF THE DRAWINGS

Figure 1:
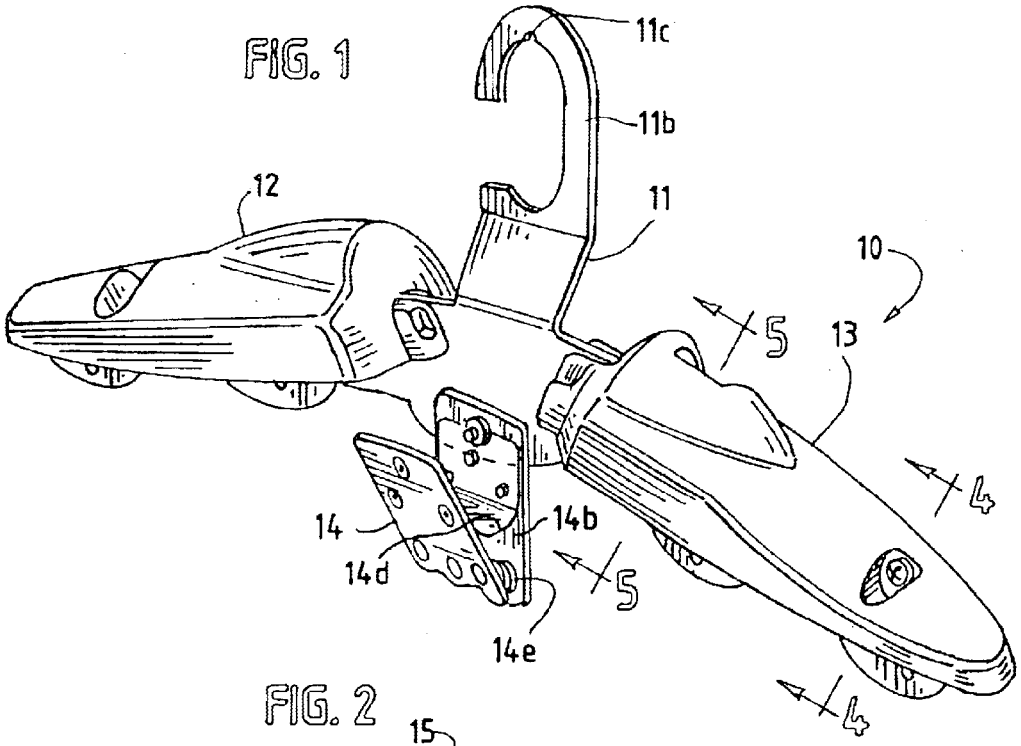
FIG. 1 is a perspective view of the garment care apparatus of the present invention, showing only one clip segment attached to the frame segment.
Figure 2:
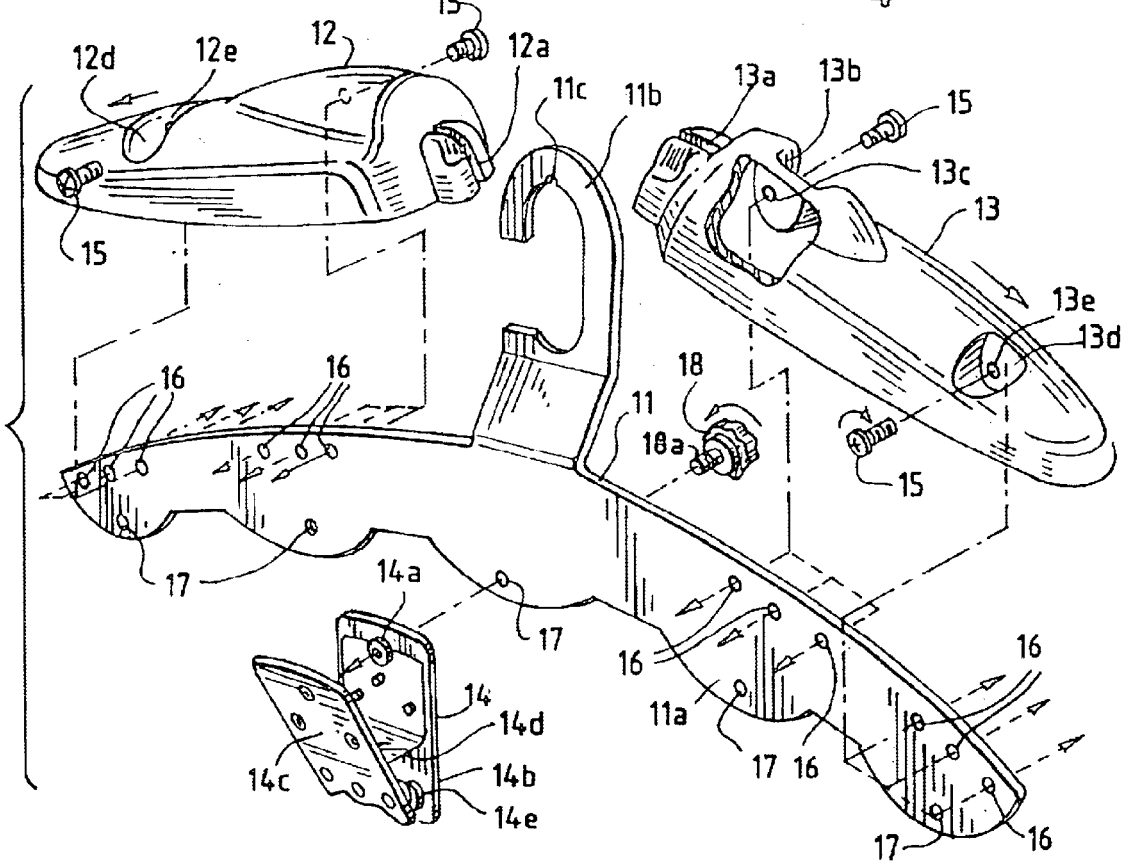
FIG. 2 is an exploded perspective view of the apparatus of FIG. 1.

Turning now to the drawings and referring specifically to FIGS. 1 and 2, the garment care apparatus (or hanger) of the present invention 10 generally includes a frame segment 11, a pair of shoulder segments 12 and 13, and one or more clip segments 14. The frame segment 11 supports the shoulder segments which engage and support the shoulder region of a garment with shoulders. It also supports the clip segment which engages and supports garments without shoulders (such as pants) and accessory garments such as gloves.

The frame segment 11 may operate above with only one or more clip segments 14 to support and hang garments. It may co-operate with only a pair of shoulder segments 12 and 13 to support and hang various garments. Finally, the frame segment 11 may co-operate with both clip segments 14 and shoulder segments 12 and 13 to hang garments.

The frame segment 11 is a plate-like member with a main body portion 11*a* and a hook portion 11*b* including a nail notch 11*c*. The hook portion 11*b* receives hooks, bars or other such structures and hangs the frame segment 11 and, thus, the apparatus 10 on that structure. The main body portion 11*a* supports the shoulder segments 12 and 13 and the clip segments 14 which support the garments, as described above.

Figure 7:
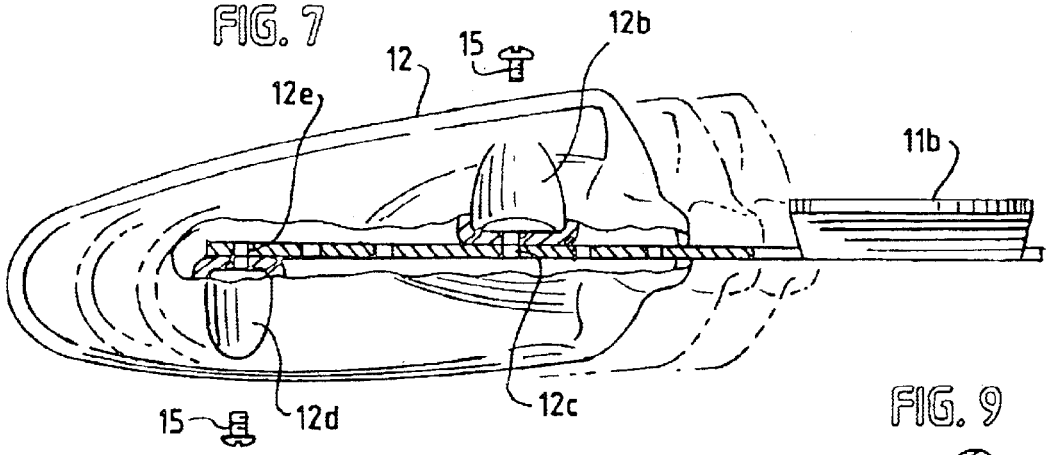
FIG. 7 is a partial sectional plane view taken along line 7—7 in FIG. 6.

The frame segment 11 is made from a brushed and powder-coated aluminum material or any other suitable material that is light and rigid and has high strength. This segment 11 is generally flat with the hook portion 11*b* offset from the main body portion 11*a* (see FIG. 7) to facilitate the hanging of the hanger 10 from a hook on a wall.

The shoulder segments 12 and 13 are elongated, cup-like shells molded of a rigid plastic or otherwise made of any other suitably light, rigid and high strength material. They have the general shape of human shoulders with longitudinal as well as lateral curvature. They define slots 12*a* and 13*a* for receiving the frame segment 11, pockets 12*b* and 13*b* with corresponding openings 12*c* and 13*c*, and pockets 12*d* and 13*d* with corresponding openings 12*e* and 13*e*, respectively (see FIGS. 4, 5 and 7). The shape of the shoulder segments 12 and 13 may differ, depending on the nature of the garments that the apparatus 10 supports.

Figure 4:
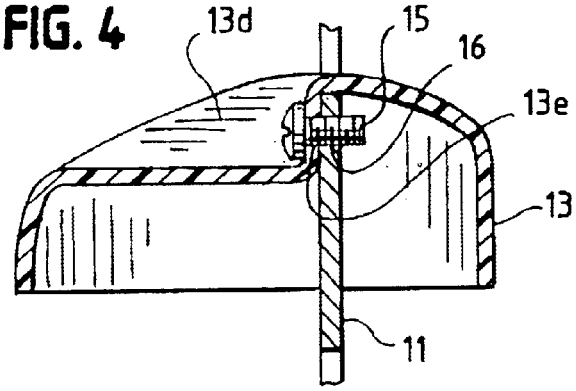
FIG. 4 is a sectional view taken along line 4—4 in FIG. 1.
Figure 5:
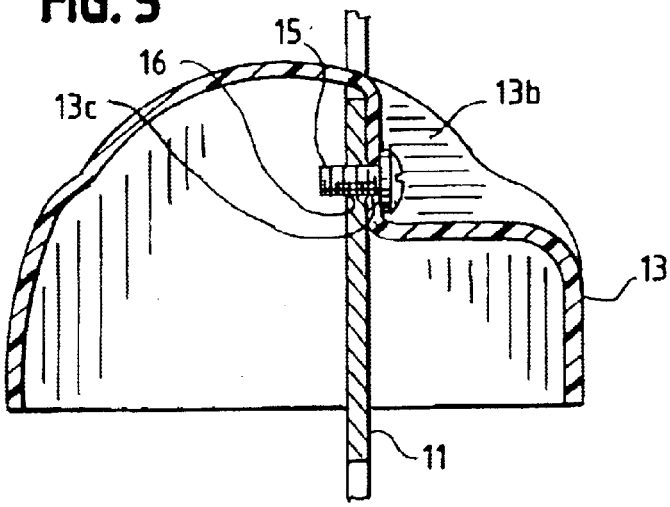
FIG. 5 is a sectional view taken along line 5—5 in FIG. 1.

Machine screws 15 extend through the openings 12*c*, 13*c*, 12*e* and 13*e* and thread into the threaded openings 16 defined by the top edge of the main body portion 11 a of the frame segment 11 (see FIGS. 4 and 5). For each of the openings 12*c*, 13*c*, 12*e* and 13*e*, the main body segment 11*a* includes three corresponding openings 16 so that one may adjust the position of the shoulder segments 12 and 13 to three different positions.

Alternatively, the frame segment 11*a* may include more than three openings 16 for each opening 12*c*, 13*c*, 12*e* and 13*e*, so that the shoulder segments 12 and 13 may adjust to more than three different positions, or it may include less than three. In addition, although the apparatus 10 uses machine screws 15 to detachably secure the shoulder segments to the frame segment, any one of a number of other known securing means may provide this securing function.

Figure 3:
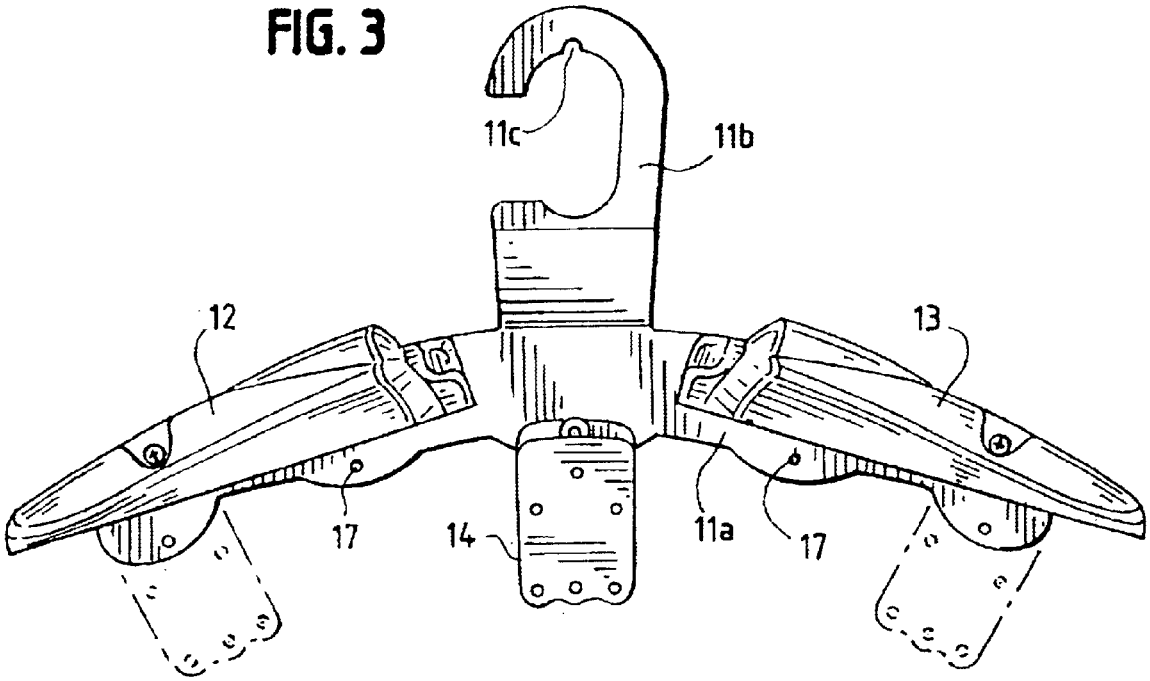
FIG. 3 is a front, elevational view of the garment care apparatus of FIG. 1.
Figure 6:
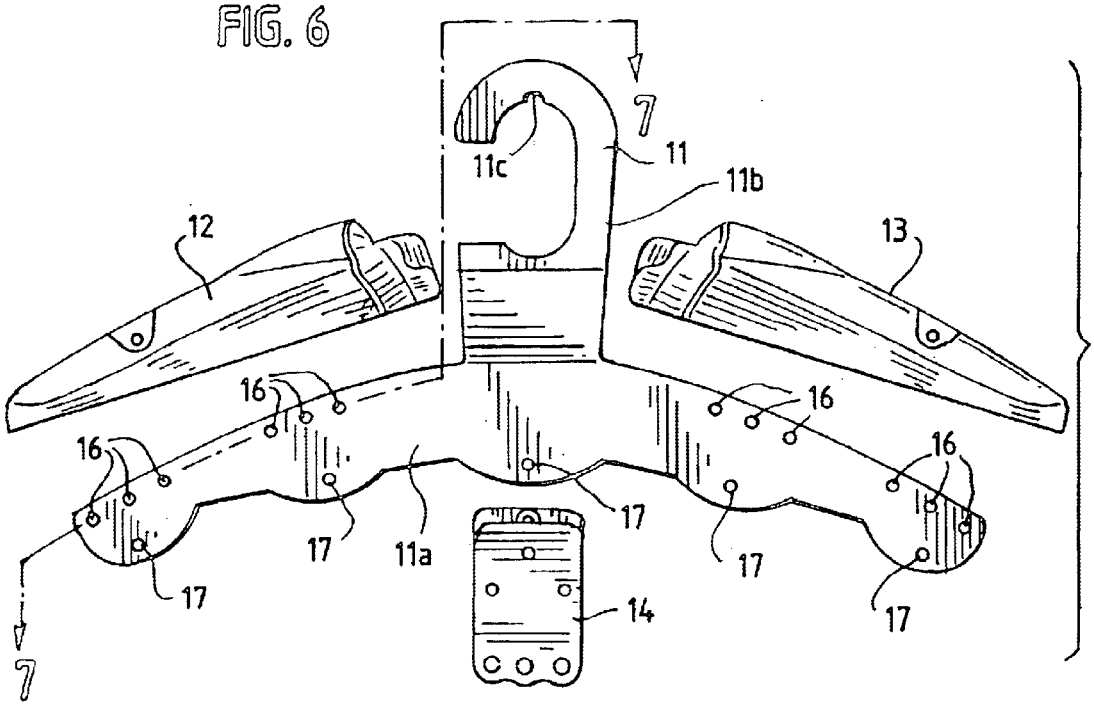
FIG. 6 is a front elevational, exploded view of the garment care apparatus of FIG. 1.

The main body portion 11 a of the frame segment 11 includes five openings 17 which represent five different positions where the frame segment 11 may support a clip segment 14 (see FIGS. 2, 3 and 6). Alternatively, the frame segment may include more than five openings or less than five. A knob fastener 18, including a machine screw 18*a*, extends through an opening 17 and threads into a threaded opening 14*a* of the clip segment 14 to releasably secure the clip segment to the frame segment.

Figure 9:
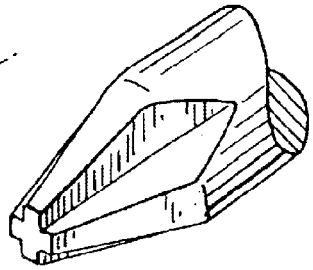
FIG. 9 is a partial perspective view of the distal end of the knob fastener used to releasably secure clip segments to the frame of the apparatus.
Figure 8:
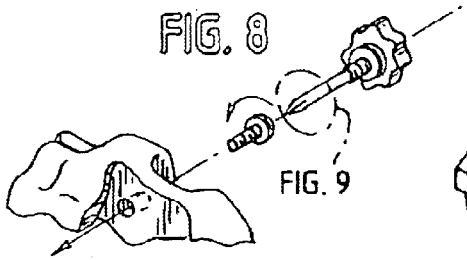
FIG. 8 is an enlarged perspective view of an alternative method of connecting a shoulder segment to the frame of the apparatus.

The clip segment 14 includes two plate portions 14*b* and 14*c*, a spring portion 14*d*, and resilient pads 14*e*. The plate and spring portions may be made of metal or any other suitable material, while the pads 14*e* may be made of rubber or any other suitable resilient or elastic material. Also, the knob fastener 18 may alternatively have a screw driver-type distal end (instead of the flat end shown in FIG. 2) so that one may use the knob fastener 18 to drive the screws 15 into the fastening positions (see FIGS. 8 and 9). In this alternative, the plate portion 14 would include an opening to accommodate the longer knob fastener 18.

A specific example of a garment case apparatus 10 according to the present invention includes a frame segment 11 having a thickness of between 0.125 and 0.187 inches and shoulder segments with a 3 inch depth or thickness. When the shoulder segments lie in the inner-most position, the hanger apparatus 10 is 17.8 inches wide. When they lie in the middle position, the hanger is 19.2 inches wide, and when they lie in the outward-most position, the hanger is 20.8 inches wide.

While the above description and the drawings disclose and illustrate one embodiment, one should understand, of course, that the invention is not limited to this embodiment. Those skilled in the art to which the invention pertains may make other modifications and other embodiments employing the principles of this invention, particularly upon considering the foregoing teachings. Therefore, by the appended claims, the applicant intends to cover any modifications and other embodiments as incorporate those features which constitute the essential features of this invention.

What is claimed is:

1. A garment care apparatus comprising a frame segment, a pair of adjustable shoulder segments secured to the frame segment on opposite sides of the frame segment, securing means for detachably securing the shoulder segments to the frame segment in at least two different positions on the frame segment, and at least one clip segment normally secured to the frame segment and fastening means for detachably fastening the clip segment to the frame segment, wherein the fastening means comprises a knob fastener with a machine screw portion that extends through an opening at a bottom edge of the frame segment and into a threaded opening in the clip segment.

2. The apparatus of claim 1, wherein the frame segment includes a plurality of openings at its bottom edge for receiving the fastener that secures a clip segment to a frame segment.

3. A garment care apparatus comprising a frame segment with a top hook portion and a main body portion, a pair of adjustable shoulder segments secured to the main body portion of the frame segment on opposite sides of the frame segment, securing means for detachably securing the shoulder segments to the frame segment in at least two different positions on the frame segment, at least one clip segment normally secured to a bottom edge of a main body portion of the frame segment and fastening means for detachably fastening the clip segment to the frame segment, wherein the frame segment is a flat plate-like member.

4. The apparatus of claim 1, wherein the frame segment includes a plurality of openings at a bottom edge of the main body portion for receiving the fastener that secures a clip segment to a frame 10 segment.

5. A garment care apparatus comprising a frame segment with a top hook portion and a main body portion, at least one clip segment normally secured to the frame segment, and fastening means for detachably fastening the clip segment to the frame segment, wherein the frame segment is a flat, plate-like member, further comprising a pair of adjustable shoulder segments secured to the main body portion of the frame segment on opposite sides of the frame segment, and securing means for detachably securing the shoulder segments to the frame segment in at least two different positions on the frame segment.

6. The apparatus of claim 5, wherein the frame segment includes a plurality of openings at a bottom edge of the main body portion for receiving the fastener that secures a clip segment to a frame 10 segment.

* * * * *